US011139111B2

(12) United States Patent
Matsumoto

(10) Patent No.: US 11,139,111 B2
(45) Date of Patent: Oct. 5, 2021

(54) INDUCTIVE COUPLING SYSTEM AND COMMUNICATION SYSTEM

(71) Applicant: Kabushiki Kaisha Toshiba, Tokyo (JP)

(72) Inventor: Masahiko Matsumoto, Kawasaki Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 72 days.

(21) Appl. No.: 16/250,402

(22) Filed: Jan. 17, 2019

(65) Prior Publication Data

US 2019/0148064 A1 May 16, 2019

Related U.S. Application Data

(63) Continuation of application No. 15/261,161, filed on Sep. 9, 2016, now Pat. No. 10,224,146.

(30) Foreign Application Priority Data

Oct. 23, 2015 (JP) ..... 2015-208975

(51) Int. Cl.
*H01F 38/14* (2006.01)
*H01F 27/28* (2006.01)

(52) U.S. Cl.
CPC ..... *H01F 38/14* (2013.01); *H01F 27/2804* (2013.01)

(58) Field of Classification Search
CPC ..... H01F 38/14; H01F 27/2804; H02J 50/00; H02J 50/10
USPC ..... 307/104
See application file for complete search history.

(56) References Cited

U.S. PATENT DOCUMENTS

| | | | | |
|---|---|---|---|---|
| 5,719,483 | A | 2/1998 | Abbott et al. | |
| 8,552,821 | B2 | 10/2013 | Nagai | |
| 9,184,723 | B2 | 11/2015 | Nagai et al. | |
| 9,589,720 | B2 | 3/2017 | Akahane | |
| 2004/0145343 | A1 | 7/2004 | Naskali et al. | |
| 2010/0301987 | A1 | 12/2010 | Belot et al. | |
| 2011/0183617 | A1 | 7/2011 | Behzad et al. | |
| 2013/0147580 | A1 | 6/2013 | Nagai | |
| 2013/0181805 | A1 | 7/2013 | Saito et al. | |
| 2014/0049338 | A1* | 2/2014 | Nagai | H01F 38/14 333/120 |

(Continued)

FOREIGN PATENT DOCUMENTS

| | | | |
|---|---|---|---|
| CN | 1860656 | A | 11/2006 |
| CN | 103339825 | A | 10/2013 |

(Continued)

OTHER PUBLICATIONS

Taiwanese Office Action dated Jun. 5, 2017 in counterpart Taiwanese patent Application No. 105129055.

*Primary Examiner* — Hal Kaplan

(57) ABSTRACT

According to one embodiment, an inductive coupling system includes a first inductor and a second inductor. The first inductor includes a first wiring pattern provided on a first board and shaped as an open loop.
The second inductor includes a second wiring pattern provided on a second board and shaped as an open loop. The second inductor is inductively coupled to the first inductor. A width of the second wiring pattern is narrower than a width of the first wiring pattern.

19 Claims, 14 Drawing Sheets

(56) References Cited

U.S. PATENT DOCUMENTS

2016/0268674 A1 9/2016 Orihara

FOREIGN PATENT DOCUMENTS

| | | | |
|---|---|---|---|
| CN | 103731038 | A | 4/2014 |
| JP | 10-049838 | A | 2/1998 |
| JP | 2776948 | B2 | 7/1998 |
| JP | 2007019439 | A | 1/2007 |
| JP | 2008-67012 | A | 3/2008 |
| TW | 201232915 | A | 8/2012 |
| TW | 201526384 | A | 7/2015 |

* cited by examiner

Comparative Example

Comparative Example

INDUCTIVE COUPLING SYSTEM AND COMMUNICATION SYSTEM

CROSS-REFERENCE TO RELATED APPLICATIONS

This application is a continuation of Application Ser. No. 15/261,161 filed Sep. 9, 2016 and is based upon and claims the benefit of priority from Japanese Patent Application No. 2015-208975 filed on Oct. 23, 2015, the entire contents of which are incorporated herein by reference.

FIELD

Embodiments described herein relate generally to an inductive coupling system and a communications system.

BACKGROUND

In recent years, a non-contact inductive coupling system is used for a board to board connection or a module to module connection, etc. electrically. As a communication system performing communication by using such inductive coupling system, a system including a transmitting circuit to transmit a signal via a transmitting inductor and a receiving circuit to receive a signal via a receiving inductor is known.

In order to miniaturize the communication system, feature sizes of the transmitting inductor and the receiving inductor are needed to be decreased. However, as these feature sizes become smaller and smaller, the system may be more susceptible to misalignment between the transmitting inductor and the receiving inductor. If the misalignment occurs, signal transmission characteristics may be degraded and a signal cannot be efficiently transmitted.

DETAILED DESCRIPTION

Figure 1:
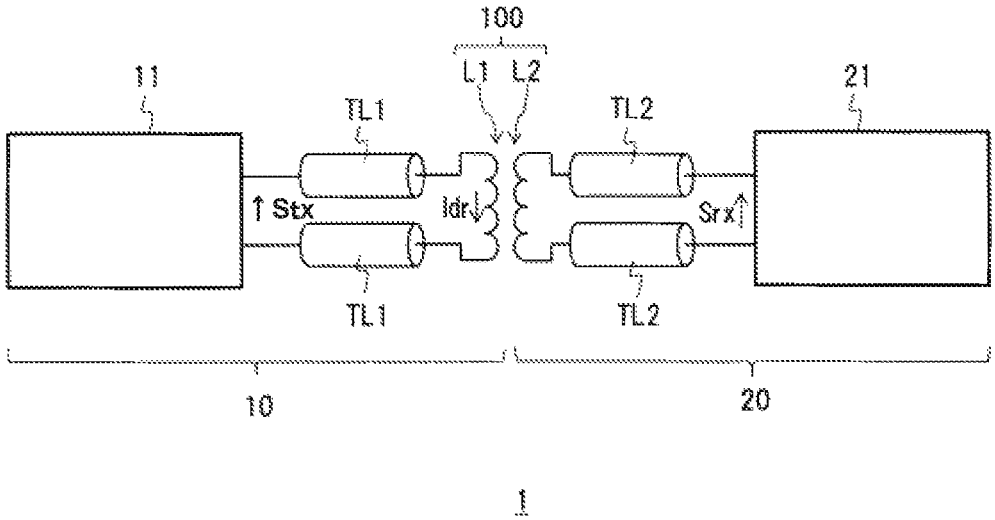
FIG. 1 is a block diagram schematically illustrating a configuration of a communication system according to a first embodiment.

Exemplary embodiments of the present invention will be described below with reference to the accompanying drawings. These embodiments are not intended to be limiting of the present invention. In the accompanying drawings, the figures may not be to scale and relative feature sizes may be exaggerated for purposes of better illustrating and understanding. In addition, components with approximately the same functions and configurations are denoted by the same reference numerals, and duplicate descriptions are given only when needed.

First Embodiment

FIG. 1 is a block diagram schematically illustrating a configuration of a communication system 1 according to a first embodiment. As illustrated in FIG. 1, the communication system 1 includes a transmitter 10 and a receiver 20. The transmitter 10 and the receiver 20 perform non-contact communication by inductive coupling.

The transmitter 10 includes a transmitting inductor (first inductor) L1 as an inductive coupling element, a pair of first transmission lines TL1 and TL1, and a transmitting circuit 11. The transmitter 10 may be configured as a module.

The first transmission lines TL1 and TL1 may include, for example, microstrip lines. One ends of the first transmission lines TL1 and TL1 are connected to the transmitting circuit 11. The other ends of the first transmission lines TL1 and TL1 are respectively connected to each end of the transmitting inductor L1. That is, the transmitting circuit 11 is connected to the transmitting inductor L1 through the first transmission lines TL1 and TL1.

The transmitting circuit 11 transmits a signal corresponding to a transmission signal Stx to a receiving circuit 21 of the receiver 20 through the first transmission lines TL1 and TL1 and the transmitting inductor L1.

The receiver 20 includes a receiving inductor (second inductor) L2 as an inductive coupling element, a pair of transmission lines TL2 and TL2, and the receiving circuit 21. The receiver 20 may also be configured as a module.

The receiving inductor L2 is inductively coupled (AC-coupled) to the transmitting inductor L1. The transmitting inductor L1 and the receiving inductor L2 are collectively referred to as an inductive coupling system 100.

The second transmission lines TL2 and TL2 may include, for example, microstrip lines. One ends of the second transmission lines TL2 and TL2 are connected to the receiving circuit 21. The other ends of the second transmission lines TL2 and TL2 are respectively connected to each end of the receiving inductor L2. That is, the receiving inductor L2 is connected to the receiving circuit 21 through the second transmission lines TL2 and TL2.

The receiving circuit 21 receives a received signal Srx corresponding to a signal transmitted through the receiving inductor L2 and the second transmission lines TL2 and TL2.

Figure 2A:
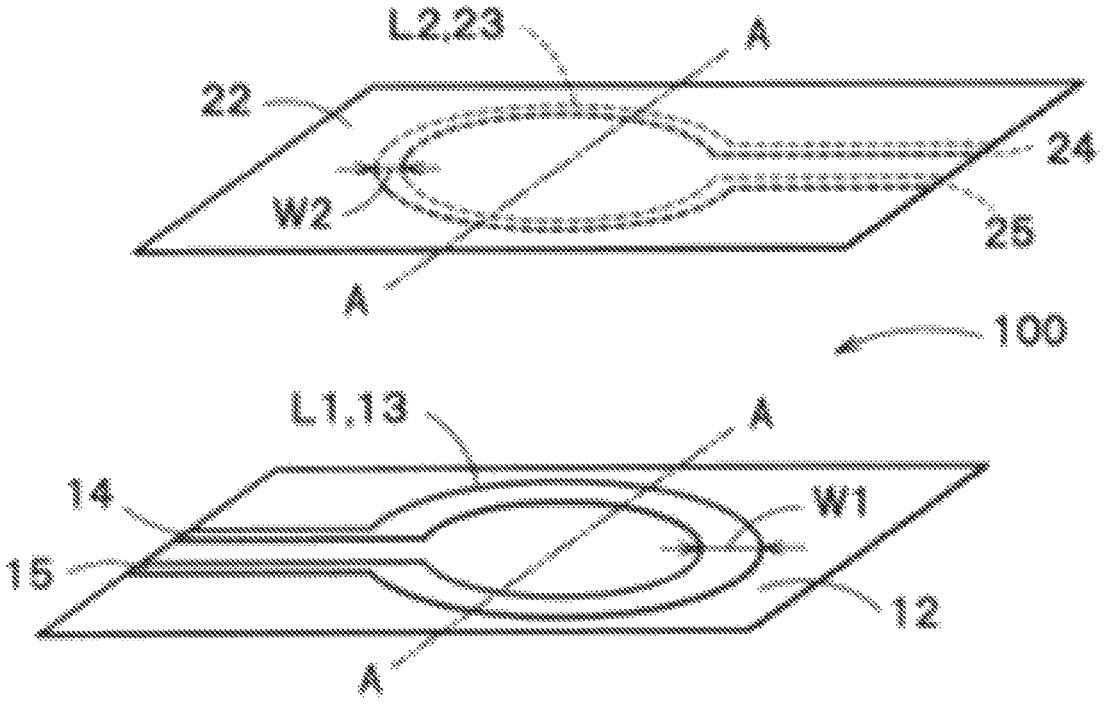
FIG. 2A is a perspective view schematically illustrating a configuration of a transmitting inductor and a receiving inductor.

FIG. 2A is a perspective view schematically illustrating a configuration of the transmitting inductor L1 and the receiving inductor L2. The transmitting inductor L1 is provided on a first board 12. The first transmission lines TL1 and TL1 and the transmitting circuit 11, not illustrated, are also provided on the first board 12.

The receiving inductor L2 is provided on a second board 22. The second transmission lines TL2 and TL2 and the receiving circuit 21, not illustrated, are also provided on the second board 22.

The transmitting inductor L1 is a planar inductor. The transmitting inductor L1 also has a first wiring pattern 13 provided on the first board 12 and shaped as an open loop. That is, the first wiring pattern 13 is a circular loop-shaped pattern. In addition, the first wiring pattern 13 has a slit portion. One end of the first wiring pattern 13 is connected to a lead-out wiring portion 14 functioning as one of the first transmission lines, TL1. The other end of the first wiring pattern 13 is connected to a lead-out wiring portion 15 functioning as the other one of the first transmission lines, TL1.

The receiving inductor L2 is a planar inductor. The receiving inductor L2 also has a second wiring pattern 23 provided on the second board 22 and shaped as an open loop.

That is, the second wiring pattern 23 is a circular loop-shaped pattern. In addition, the second wiring pattern 23 has a slit portion. One end of the second wiring pattern 23 is connected to a lead-out wiring portion 24 functioning as one of the second transmission lines, TL2. The other end of the second wiring pattern 23 is connected to a lead-out wiring portion 25 functioning as the other one of the second transmission lines, TL2.

A width W2 of the second wiring pattern 23 is narrower than a width W1 of the first wiring pattern 13. The width W2 may be, for example, 0.1 mm-1 mm. The width W1 may be, for example, less than four times of the width W2.

In a plan view, a shape of the first wiring pattern 13 is similar to a shape of the second wiring pattern 23. Inner diameters (i.e. innermost diameters) of the first wiring pattern 13 and the second wiring pattern 23 are set so that the first wiring pattern 13 and the second wiring pattern 23 are overlapped except for the slit portions when the first wiring pattern 13 and the second wiring pattern 23 are arranged in a manner that a center of a loop of the first wiring pattern 13 and a center of a loop of the second wiring pattern 23 are coincident with each other in a plan view. The inner diameter of the first wiring pattern 13 may be, for example, several mm.

The first wiring pattern 13 and the second wiring pattern 23 include a thin film of metal such as, for example, copper. The first wiring pattern 13 and the second wiring pattern 23 can be formed with a well-known method for manufacturing a printed board.

When performing communication, the transmitter 10 and the receiver 20 are arranged in proximity to each other so that the transmitting inductor L1 and the receiving inductor L2 are closely facing each other. In other words, the first board 12 and the second board 22 are arranged to face each other.

For example, cases, housings, etc. of the transmitter 10 and the receiver 20 may be provided with positioning members (not illustrated). As the positioning members, for example, one case may be provided with a projection and the other case may be provided with a hole fitted to the projection. By fitting these positioning members together, the first wiring pattern 13 and the second wiring pattern 23 can be positioned.

Figure 2B:
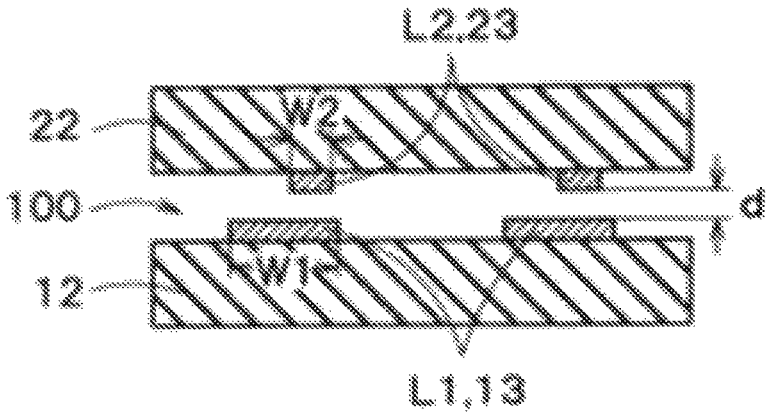
FIG. 2B is a longitudinal sectional view taken along the line A-A of FIG. 2A, illustrating the transmitting inductor and the receiving inductor arranged in proximity to each other.

FIG. 2B is a longitudinal sectional view taken along the line A-A of FIG. 2A illustrating the transmitting inductor L1 and the receiving inductor L2 arranged in proximity to each other. A distance d between the first wiring pattern 13 and the second wiring pattern 23 may be, for example, several hundred μm. A sheet including resin, etc. having insulation properties may be sandwiched between the first wiring pattern 13 and the second wiring pattern 23.

Figure 2C:
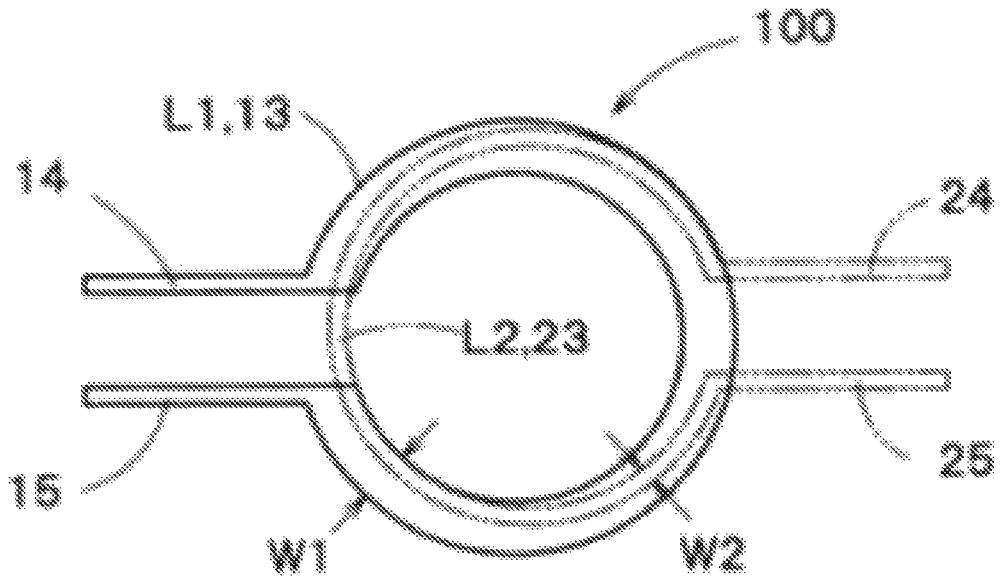
FIG. 2C is a top view of the transmitting inductor and the receiving inductor in FIG. 2B.

FIG. 2C is a top view illustrating the transmitting inductor L1 and the receiving inductor L2 in FIG. 2B. In FIG. 2C, the first board 12 and the second board 22 are not illustrated.

With the arrangement described above, magnetic field lines that vary in time are generated to the transmitting inductor L1 by an AC current flowing through the transmitting inductor L1. The magnetic field lines pass through the loop of the receiving inductor L2.

Accordingly, a current is generated also in the receiving inductor L2 due to electromagnetic induction. That is, the receiving inductor L2 is inductively coupled to the transmitting inductor L1. As a result, a signal is transmitted from the transmitting inductor L1 to the receiving inductor L2 by the electromagnetic induction.

Figure 3:
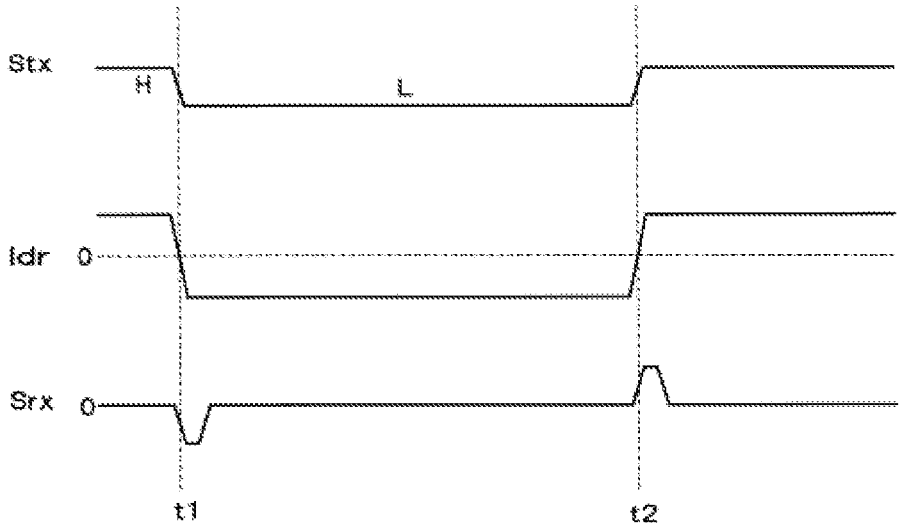
FIG. 3 is a timing diagram of the communication system in FIG. 1.

FIG. 3 is a timing diagram of the communication system 1 in FIG. 1. In an example shown in FIG. 3, a transmission signal Stx changes from "H" to "L" at a time t1 and changes from "L" to "H" at a time t2.

The transmitting circuit 11 applies a positive driving current Idr to the transmitting inductor L1 in synchronization with a rising edge of the transmission signal Stx and applies a negative driving current Idr to the transmitting inductor L1 in synchronization with a falling edge of the transmission signal Stx. As a result, in the transmitting inductor L1, the positive driving current Idr flows until the time t1, the negative driving current Idr flows from the time t1 to the time t2, and the positive driving current Idr flows after the time t2.

Accordingly, a negative pulse is generated at the time t1 and a positive pulse is generated at the time t2 as a receiving signal Srx. The receiving circuit 21 obtains received data based on the receiving signal Srx.

Now, an inductive coupling system 100X, which is a comparative example as known by the inventor of the present application, will be described.

Figure 4A:
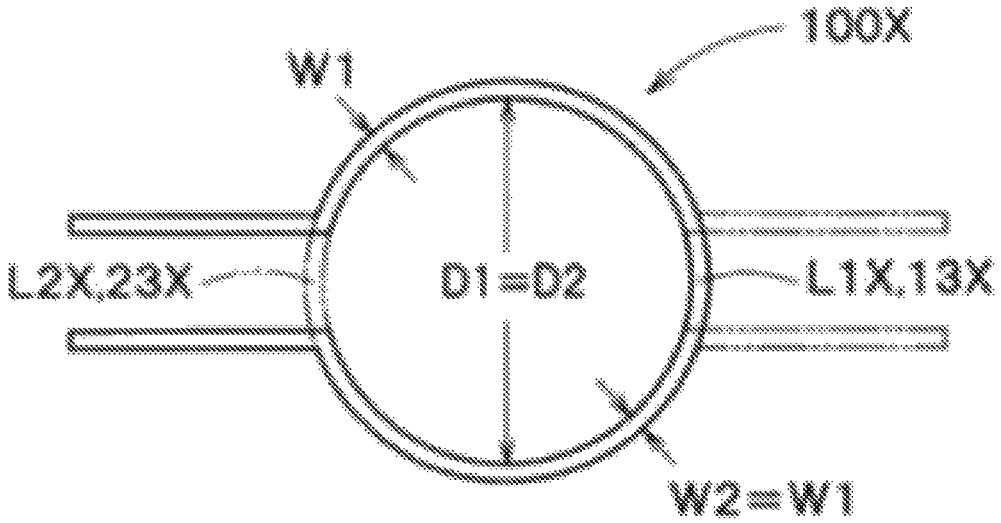
FIG. 4A is a top view illustrating a transmitting inductor and a receiving inductor of a comparative example which are arranged at optimal positions.
Figure 4B:
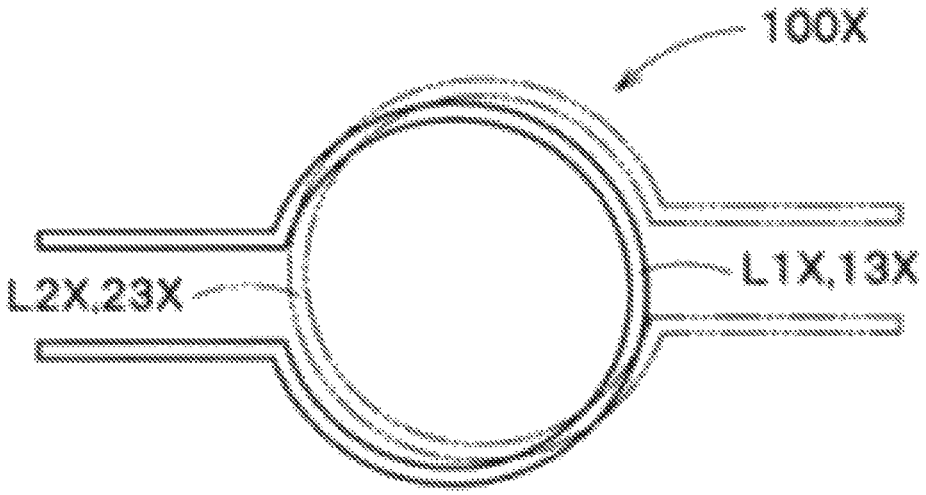
FIG. 4B is a top view illustrating the transmitting inductor and the receiving inductor of a comparative example in which misalignment occurs.

FIG. 4A is a top view illustrating a transmitting inductor L1X and a receiving inductor L2X of the comparative example which are arranged at optimal positions. FIG. 4B is a top view illustrating the transmitting inductor L1X and the receiving inductor L2X of the comparative example in which misalignment occurs. In FIGS. 4A and 4B, boards are not illustrated.

In the inductive coupling system 100X of the comparative example, a width W1 of a first wiring pattern 13X of the transmitting inductor L1X and a width W2 of a second wiring pattern 23X of the receiving inductor L2X are equal. An inner diameter D1 of the first wiring pattern 13X and an inner diameter D2 of the second wiring pattern 23X are also equal. Accordingly, an area of a region surrounded by the first wiring pattern 13X and an area of a region surrounded by the second wiring pattern 23X are equal.

At optimal positions as shown in FIG. 4A, a center of a loop of the first wiring pattern 13X and a center of a loop of the second wiring pattern 23X are coincident with each other.

Accordingly, the first wiring pattern 13X and the second wiring pattern 23X are overlapped except for slit portions.

Consequently, an area where the region surrounded by the first wiring pattern 13X and the region surrounded by the second wiring pattern 23X are overlapped becomes the maximum.

On the other hand, as shown in FIG. 4B, as the first wiring pattern 13X and the second wiring pattern 23X are more misaligned from the optimal position with each other, the area where the region surrounded by the first wiring pattern 13X and the region surrounded by the second wiring pattern 23X are overlapped becomes more smaller, compared with FIG. 4A.

Accordingly, the more the first wiring pattern 13X and the second wiring pattern 23X are misaligned from the optimal position with each other, the more an amount of magnetic flux passing through the region surrounded by the second wiring pattern 23X is decreased. As a result, signal transmission characteristics including a coupling coefficient, are degraded, so that amplitude of the receiving signal Srx is reduced accordingly. The reduction of the amplitude of the receiving signal Srx is not preferable in view of ensuring an S/N ratio, etc.

Such misalignment may be caused by manufacturing variations of the first wiring pattern 13X and the second wiring pattern 23X or manufacturing variations of a module, etc.

In contrast, according to the embodiment, the width W2 of the second wiring pattern 23 is narrower than the width W1 of the first wiring pattern 13.

For this reason, an area where the region surrounded by the first wiring pattern 13 and the region surrounded by the second wiring pattern 23 are overlapped can be hardly changed as long as the first wiring pattern 13 and the second wiring pattern 23 are overlapped except for the slit portions, even if the center of the loop of the first wiring pattern 13 and the center of the loop of the second wiring pattern 23 are not coincident with each other, as illustrated in FIG. 2C.

Accordingly, an amount of magnetic flux passing through the region surrounded by the second wiring pattern 23 can be maintained substantially constant as long as the misalignment is smaller than a certain value.

Therefore, the embodiment can reduce degradation of signal transmission characteristics due to misalignment more than the comparative example.

Here, the receiving inductor L2 may have the first wiring pattern 13 and the transmitting inductor L1 may have the second wiring pattern 23 of which a width is narrower than a width W1 of the first wiring pattern 13.

The shape of the loop of the first and second wiring patterns 13 and 23 may not be particularly limited, and may be, for example, oval or polygonal.

However, a circular and oval shapes which do not have corners are more preferable than a polygonal shape since reflection of a signal can be reduced.

Moreover, FIG. 2C illustrates an example in which the lead-out wiring portion 14 and the lead-out wiring portion 24 are arranged in parallel and led out in the opposite direction to each other. In addition to that, the lead-out wiring portion 15 and the lead-out wiring portion 25 are arranged in parallel and led out in the opposite direction to each other. However the directions to which the lead-out wiring portion 14, etc. are led out are not limited.

The lead-out wiring portions 24 and 25, for example, may be led out in directions which intersect perpendicularly to the lead-out wiring portions 14 and 15.

Second Embodiment

According to a second embodiment, a width W1 of a first wiring pattern 13A and a width W2 of a second wiring pattern 23A are equal. An area of a region surrounded by the second wiring pattern 23A is different from an area of a region surrounded by the first wiring pattern 13A. The differences from the first embodiment will be mainly explained below.

Figure 5:
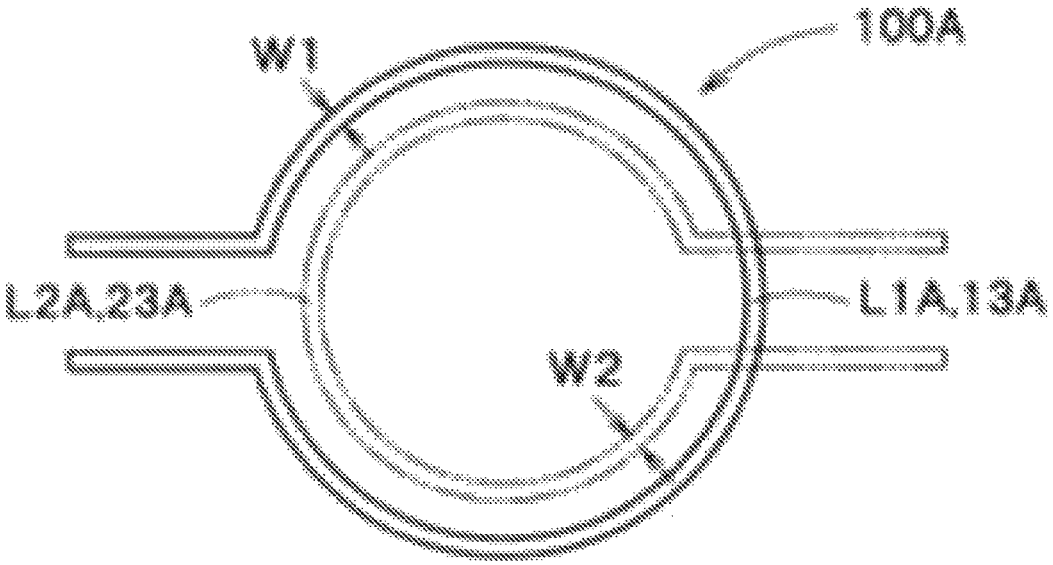
FIG. 5 is a top view illustrating a transmitting inductor and a receiving inductor which are arranged to face each other according to a second embodiment.

FIG. 5 is a top view illustrating a transmitting inductor L1A and a receiving inductor L2A arranged to face each other according to the second embodiment. As illustrated in FIG. 5, the width W1 of the first wiring pattern 13A of the transmitting inductor L1A and the width W2 of the second wiring pattern 23A of the receiving inductor L2A are equal in an inductive coupling system 100A. The area of the region surrounded by the second wiring pattern 23A is smaller than the area of the region surrounded by the first wiring pattern 13A.

With this configuration, according to the embodiment, an area where the region surrounded by the first wiring pattern 13A and the region surrounded by the second wiring pattern 23A are overlapped can be maintained substantially constant as long as the second wiring pattern 23A is located within a loop of the first wiring pattern 13A, even if a center of the loop of the first wiring pattern 13A and a center of a loop of the second wiring pattern 23A are not coincident with each other.

Accordingly, an amount of magnetic flux passing through the region surrounded by the second wiring pattern 23A can be maintained substantially constant as long as misalignment is smaller than a certain value.

Therefore, the embodiment can reduce degradation of signal transmission characteristics due to misalignment more than the comparative example. For example, such an effect can be obtained when communication is performed using a driving current Idr having larger amplitude and lower frequency than that in the first embodiment.

Third Embodiment

A third embodiment is different from the first embodiment in that a core 36 passes thorough loops of a first and a second wiring patterns 13 and 23. The differences from the first embodiment will be mainly explained below.

Figure 6:
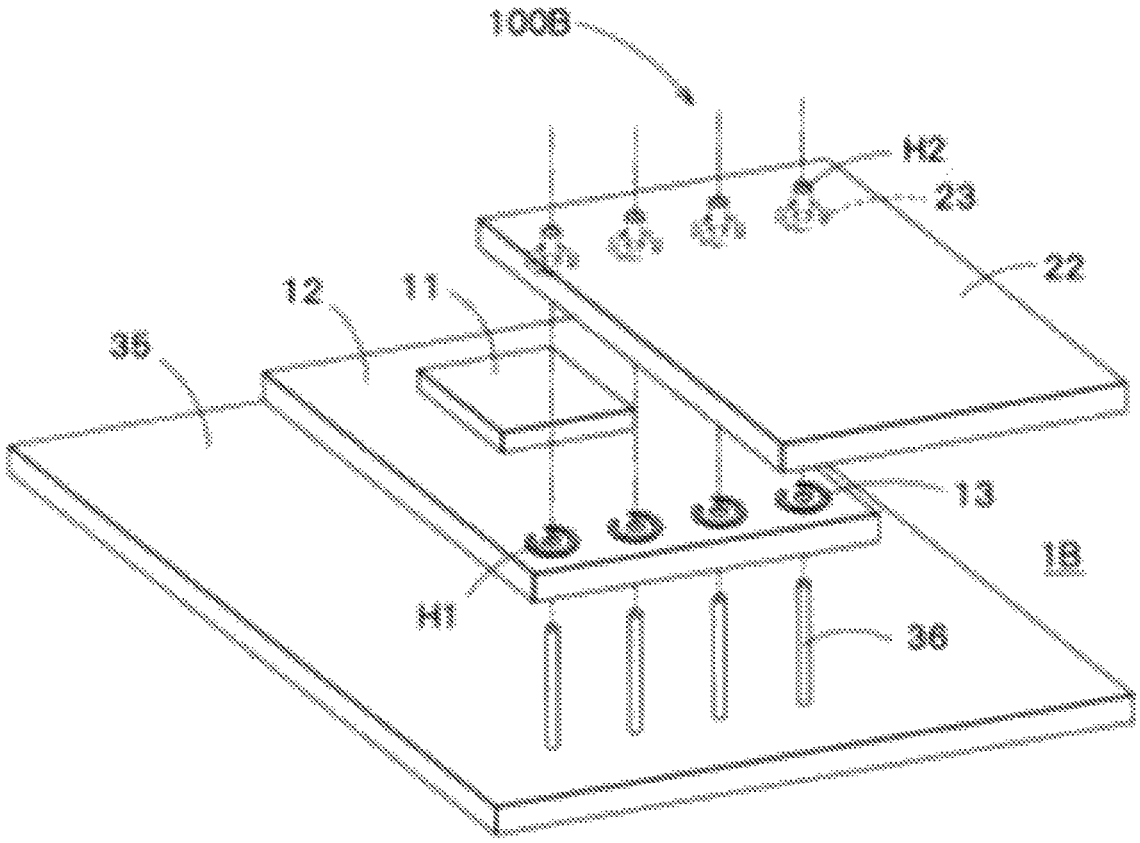
FIG. 6 is an exploded perspective view schematically illustrating a communication system according to a third embodiment.

FIG. 6 is an exploded perspective view schematically illustrating a communication system 1B according to the third embodiment. The communication system 1B further includes a fixing board 35. The fixing board 35 is provided with the core 36 on a surface thereof. The core 36 is bar-shaped. A position of the core 36 is corresponding to an inner portion of a loop of each first wiring pattern 13. The core 36 is extended in a direction perpendicular to the surface of the fixing board 35. The core 36 includes material with high magnetic permeability such as iron.

A through hole H1 is provided in the loop of each first wiring pattern 13. The through hole H1 penetrates a first board 12 in a direction perpendicular to a surface of the first board 12. In this example four first wiring patterns 13 are illustrated but the number of the first wiring patterns 13 is not limited to this number.

A through hole H2 is provided in the loop of each second wiring pattern 23. The through hole H2 penetrates a second board 22 in a direction perpendicular to a surface of the second board 22.

In the illustrated example, the number of the second wiring patterns 23 is four. As with the first embodiment, a width W2 of the second wiring pattern 23 is narrower than a width W1 of the first wiring pattern 13.

The first board 12 is mounted on the fixing board 35 in a manner that each core 36 passes through the corresponding through hole H1.

The second board 22 is mounted on the first board 12 in a manner that each core 36 passes through the corresponding through hole H2.

Figure 7:
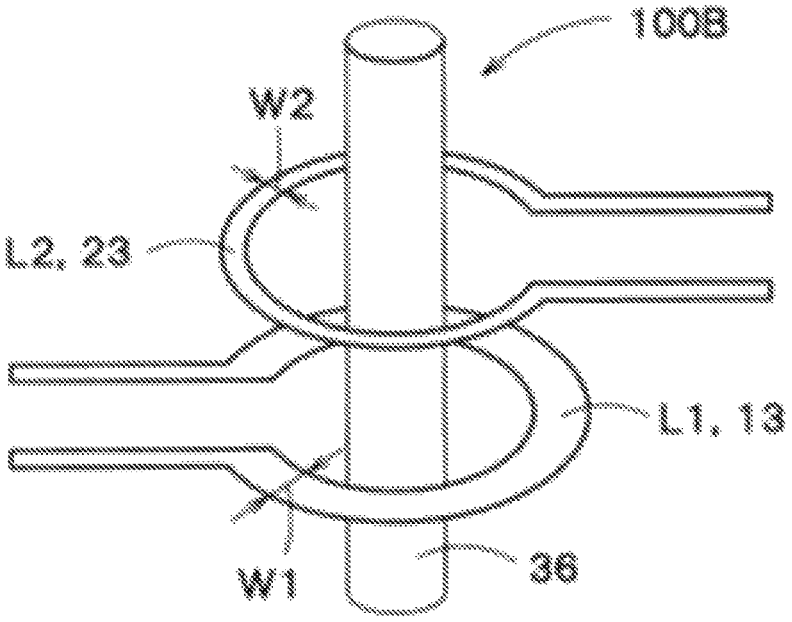
FIG. 7 is a view schematically illustrating a configuration of an inductive coupling system according to the third embodiment.

Accordingly, a configuration of an inductive coupling system 100B is as illustrated in FIG. 7.

FIG. 7 is a view schematically illustrating the configuration of the inductive coupling system 100B according to the third embodiment. In FIG. 7, the first and second boards 12 and 22 are not illustrated. The core 36 passes through the loops of the first wiring pattern 13 and the second wiring pattern 23. The inductive coupling system 100B includes the core 36 in addition to the first and second inductors L1 and L2. The first wiring pattern 13 and the second wiring pattern 23 are closely arranged to face each other.

As described above, according to the embodiment, the core 36 has higher magnetic permeability than air, resin, etc. which is between the first wiring pattern 13 and the second wiring pattern 23, and passes through the loops of the first wiring pattern 13 and the second wiring pattern 23. Accordingly, the coupling coefficient can be increased.

In addition, since the width W2 of the second wiring pattern 23 is narrower than the width W1 of the first wiring pattern 13, the embodiment can reduce degradation of signal transmission characteristics due to misalignment more than the comparative example, as with the first embodiment.

The embodiment also may be combined with the first or second embodiment.

Fourth Embodiment

A fourth embodiment is different from the first embodiment in having a metal pattern 16 in a loop of a first wiring pattern 13. The differences from the first embodiment will be mainly explained below.

Figure 8:
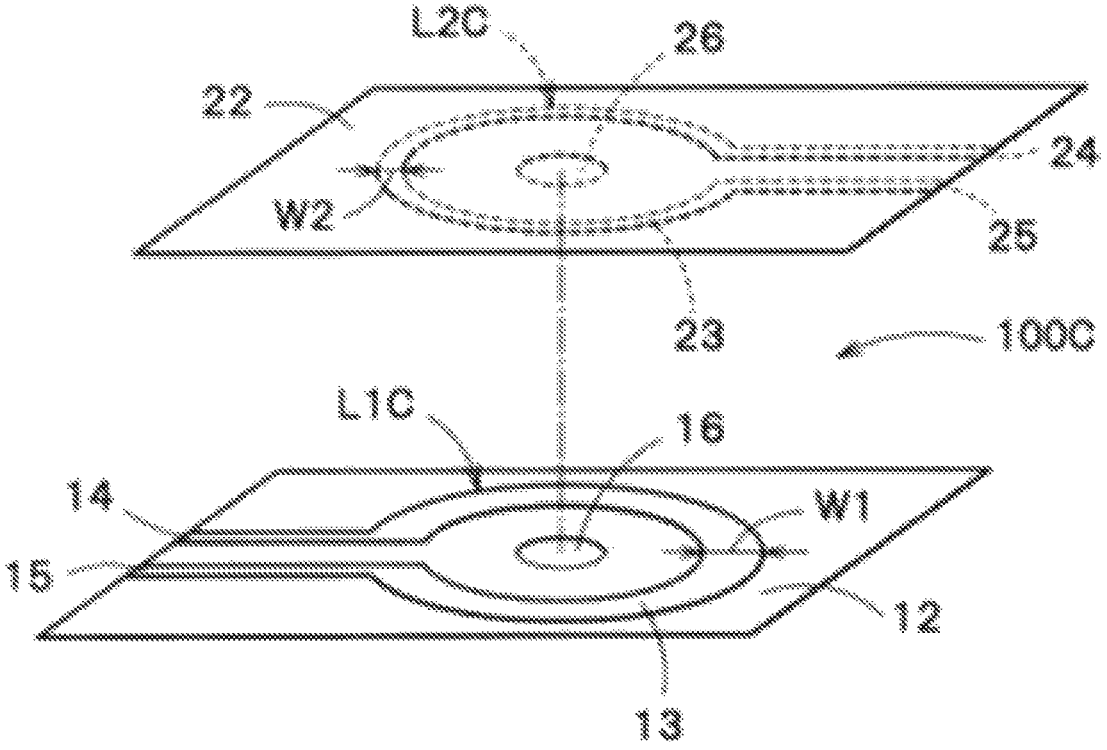
FIG. 8 is a perspective view schematically illustrating a configuration of a transmitting inductor and a receiving inductor according to a fourth embodiment.

FIG. 8 is a perspective view schematically illustrating a configuration of a transmitting inductor (first inductor) L1C and a receiving inductor (second inductor) L2C according to the fourth embodiment. The first inductor L1C includes the metal pattern 16 provided in a loop of the first wiring pattern 13 on a first board 12.

A shape of the metal pattern 16 is preferably corresponding to a shape of the first wiring pattern 13. The shape in this example is circular. The metal pattern 16 is provided in a center of the loop of the first wiring pattern 13 and separated from the first wiring pattern 13. A center of the metal pattern 16 is preferably coincident with the center of the loop of the first wiring pattern 13 in a plan view. This is because magnetic field lines can be more uniformly generated.

The second inductor L2C includes a metal pattern 26 provided in a loop of a second wiring pattern 23 on a second board 22. A shape of the metal pattern 26 is preferably corresponding to a shape of the second wiring pattern 23. The shape in this example is circular. The metal pattern 26 is provided in a center of the loop of the second wiring pattern 23 and separated from the second wiring pattern 23. A center of the metal pattern 26 is preferably coincident with the center of the loop of the second wiring pattern 23 in a plan view.

Diameters of the metal patterns 16 and 26 may not be particularly limited, and may be set approximately to obtain desired characteristics. The metal patterns 16 and 26 may include the same material with the first and second wiring patterns 13 and 23. This can facilitate manufacturing.

As described above, according to the embodiment, the metal patterns 16 and 26 functioning as a core are provided and have higher magnetic permeability than air, resin, etc. which is between the first wiring pattern 13 and the second wiring pattern 23. Accordingly, the coupling coefficient can be increased. In addition to that, since there is no need to provide through holes to the first and the second boards 12 and 22, the manufacturing can be easy compared with the third embodiment. The configuration also can be more simplified than that of the third embodiment.

Moreover, an effect similar to that of the first embodiment can be obtained.

When a desired coupling coefficient can be obtained, either of metal patterns 16 or 26 may not need to be provided.

This embodiment also may be combined with the first embodiment or the second embodiment.

Fifth Embodiment

A fifth embodiment is different from the first embodiment in that each of a transmitting inductor L1D and a receiving inductor has a multi-turn loop. The differences from the first embodiment will be mainly explained below.

Figure 9:
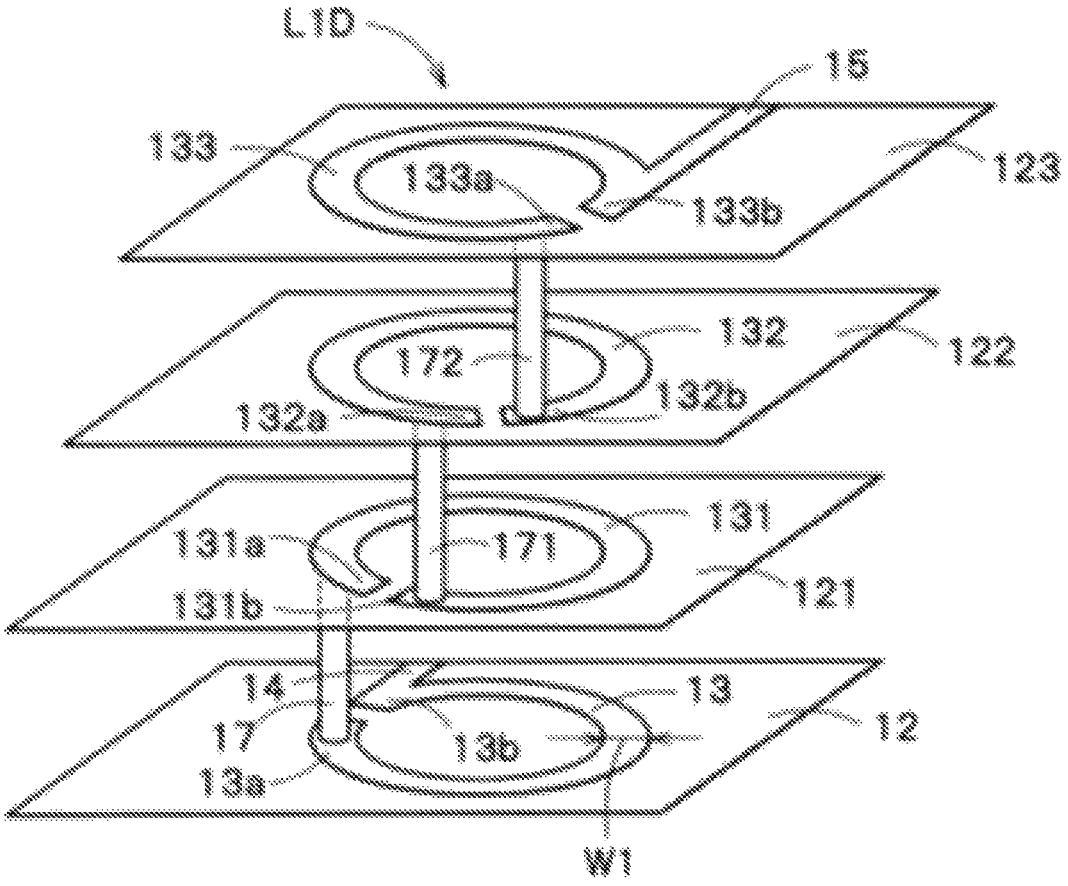
FIG. 9 is a perspective view schematically illustrating a configuration of a transmitting inductor according to a fifth embodiment.

FIG. 9 is a perspective view schematically illustrating a configuration of the transmitting inductor L1D according to the fifth embodiment.

The transmitting inductor L1D further includes additional wiring patterns 131-133 and vias 17,171 and 172.

The additional wiring pattern 131 shaped as an open loop is provided on an additional board 121 stacked on a first wiring pattern 13.

The additional wiring pattern 132 shaped as an open loop is provided on an additional board 122 stacked on the additional wiring pattern 131.

The additional wiring pattern 133 shaped as an open loop is provided on an additional board 123 stacked on the additional wiring pattern 132.

Each of the first wiring pattern 13 and the additional wiring patterns 131-133 have the same shape. A center of a loop of the first wiring pattern 13 is coincident with centers of the additional wiring patterns 131-133 in a plan view.

One end 131*a* of the additional wiring pattern 131 is electrically connected to one end 13*a* of the first wiring pattern 13 through a via 17 so that a direction of a current flowing through the first wiring pattern 13 is equal to a direction of a current flowing through the additional wiring pattern 131.

The other end 13*b* of the first wiring pattern 13 is connected to a lead-out wiring portion 14.

One end 132*a* of the additional wiring pattern 132 is electrically connected to one end 131*b* of the additional wiring pattern 131 through a via 171 so that the direction of the current flowing through the additional wiring pattern 131 is equal to a direction of a current flowing through the additional wiring pattern 132.

One end 133*a* of the additional wiring pattern 133 is electrically connected to one end 132*b* of the additional wiring pattern 132 through a via 172 so that the direction of the current flowing through the additional wiring pattern 132 is equal to a direction of a current flowing through the additional wiring pattern 133 are equal. The other end 133*b* of the additional wiring pattern 133 is connected to a lead-out wiring portion 15.

Accordingly, in a plan view, when a current flows through the first wiring pattern 13 in a clockwise direction, currents flow through the additional wiring patterns 131-133 in a clockwise direction as well. In addition, when a current flows through the first wiring pattern 13 in a counterclockwise direction, currents flow through the additional wiring patterns 131-133 in a counterclockwise direction as well.

As described above, the number of turns of the transmitting inductor L1D is four.

In FIG. 9, the first board 12 and the additional boards 121-123 are illustrated as being separated from each other for purpose of better understanding. However, actually, for example, the first wiring pattern 13 and the additional board 121 are stacked to be in contact with each other. Such a configuration may be implemented by a multi-layer printed circuit board.

A configuration of the receiving inductor is similar to that of the transmitting inductor L1D, except for a width W2 of the second wiring pattern 23 which is narrower than a width W1 of the first wiring pattern 13. The illustration of the receiving inductor is omitted here.

As described above, according to the embodiment, the first wiring pattern 13 and the additional wiring patterns 131-133 are stacked in a direction perpendicular to the first board 12. Accordingly, inductance of the transmitting inductor L1D can be increased without increasing an area of a surface of the first board 12. Inductance of the receiving inductor can also be increased in the same way. Thus the coupling coefficient can be increased.

Moreover, an effect similar to that of the first embodiment can be obtained. In addition, the number of turns of the transmitting inductor L1D and the receiving inductor, i.e. the number of stacks, may not be particularly limited, and may be set based on a required coupling coefficient.

Furthermore, either only one of the transmitting inductor or the receiving inductor may have the configuration as illustrated in FIG. 9.

The embodiment also may be combined with any of the second to fourth embodiments.

Sixth Embodiment

A sixth embodiment is different from the first embodiment in that a metal pattern 18 is provided on a back surface of a first board 12. The differences from the first embodiment will be mainly explained below.

Figure 10:
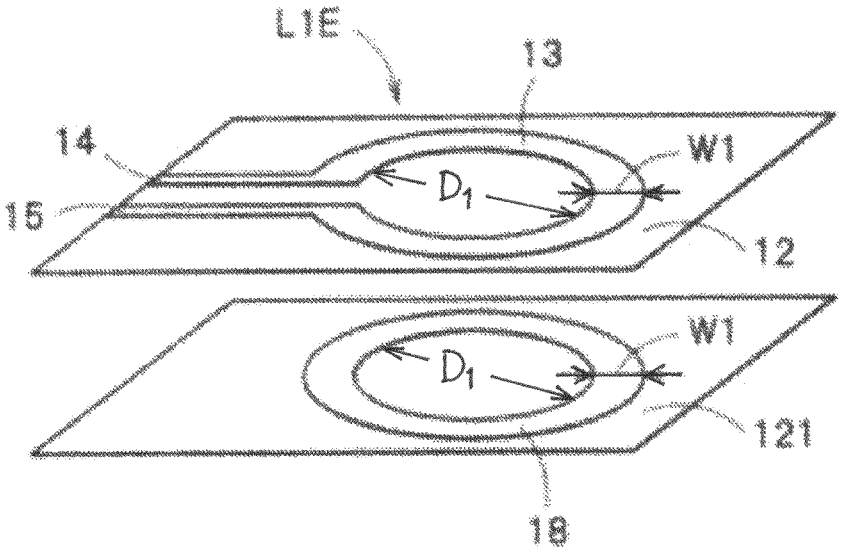
FIG. 10 is an exploded perspective view schematically illustrating a configuration of a transmitting inductor according to a sixth embodiment.

FIG. 10 is an exploded perspective view schematically illustrating a configuration of a transmitting inductor L1E according to the sixth embodiment. The transmitting inductor L1E includes the metal pattern 18 which faces a first wiring pattern 13 via the first board 12. Specifically, the metal pattern 18 is provided on an additional board 121. The first board 12 and the additional board 121 are stacked, and the metal pattern 18 is sandwiched between the first board 12 and the additional board 121. Such a configuration is implemented by a multi-layer printed circuit board.

The metal pattern 18 is circular and shaped as a closed loop. Inner diameters D1 and widths W1 of the metal pattern 18 and a first wiring pattern 13 may be the same. Centers of loops of the metal pattern 18 and the first wiring pattern 13 may be coincident with each other in a plan view. The metal pattern 18 is not electrically connected to the first wiring pattern 13 and not supplied with power.

With this configuration, magnetic field lines that vary in time are generated when an alternative current flows through the first wiring pattern 13 of the transmitting inductor L1E. The magnetic field lines passing through the loop of the metal pattern 18 vary in time. Because of this, a counter electromotive force occurs in the metal pattern 18. Accordingly, magnetic field lines are generated which cancel a magnetic field of the first wiring pattern 13 on a metal pattern 18 side. As a result, the magnetic field on an side of the additional board 121 opposite to the metal pattern 18 becomes weaker than the magnetic field on a first wiring pattern 13 side of the first board 12.

Thus, in the transmitting inductor L1E, the magnetic field lines in an unwanted direction opposite to a side where a second wiring pattern 23 (not illustrated) is inductively coupled to can be weakened. That is, it is possible to give directivity in inductive coupling. By reducing the magnetic field lines in the unwanted direction, influence of the magnetic field lines on peripheral equipment can be reduced.

Moreover, an effect similar to that of the first embodiment can be obtained.

Figure 11:
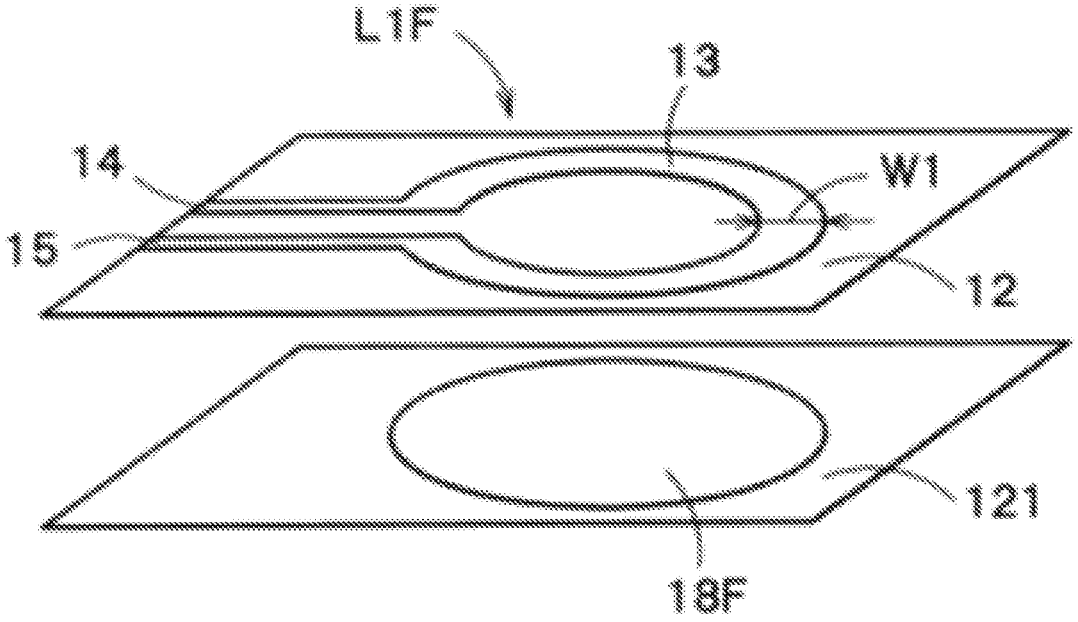
FIG. 11 is an exploded perspective view schematically illustrating a configuration of another transmitting inductor according to the sixth embodiment.

FIG. 11 is an exploded perspective view schematically illustrating a configuration of another transmitting inductor L1F according to the sixth embodiment. The differences from FIG. 10 will be mainly explained below.

A metal pattern 18F has a disk-like shape having no opening in a center. A diameter of the metal pattern 18F may be the same as an outer diameter (outermost diameter) of a first wiring pattern 13. A center of the metal pattern 18F may be coincident with a center of a loop of the first wiring pattern 13 in a plan view.

In this configuration, when magnetic field lines that vary in time are generated to the first wiring pattern 13, magnetic field lines passing through the metal pattern 18F vary in time. Because of this, an eddy current is generated in the metal pattern 18F. Accordingly, magnetic field lines are generated which cancel a magnetic field of the first wiring pattern 13 on a metal pattern 18F side.

As a result, the magnetic field on an side of additional board 121 opposite to the metal pattern 18F becomes weaker than the magnetic field on the first wiring pattern 13 side of the first board 12. Thus, the same effect with the configuration of FIG. 10 can be obtained.

The metal patterns 18 and 18F may be directly provided on a back surface of the first board 12 without providing the additional board 121.

The embodiment also may be combined with the second, fourth, or fifth embodiment.

The embodiments described above are provided as examples and not intended to limit the scope of the invention. Indeed, the novel embodiments described herein may possibly be embodied in various other forms; and furthermore, various omissions, substitutions and changes may be made by referring to the embodiments described herein without being beyond the scope of the invention.

The embodiments and such variations of the embodiments are included in the scope or summary of the invention and also included in the invention as claimed and the equivalents thereof.

What is claimed is:

1. A communication system including an inductive coupling device, the inductive coupling device comprising:

a first inductor which includes a first wiring pattern with a loop shape having a slit and provided on a first board; and a second inductor which includes a second wiring pattern with a loop shape, provided on a second board and inductively coupled to the first inductor, the second wiring pattern being opposite to the first wiring pattern;

wherein a width of the second wiring pattern is narrower than a width of the first wiring pattern.

2. The communication system according to claim 1, wherein the first wiring pattern of a transmitting inductor and the second wiring pattern of a receiving inductor are closely facing each other.

3. The communication system according to claim 1, wherein a center of the loop shape of the first wiring pattern and a center of the loop shape of the second wiring pattern are coincident with each other in a plan view.

4. The communication system according to claim 3, wherein the second wiring pattern comprises a slit, wherein the slit of the first wiring pattern and the slit of the second wiring pattern are, respectively, a circular shape or an oval shape which do not have corners.

5. The communication system according to claim 1, wherein the inductive coupling device further has an insulator sandwiched between the first wiring pattern and the second wiring pattern.

6. The communication system according to claim 1, wherein one end of the first wiring pattern is connected to a first lead-out wiring and the other end of the first wiring pattern is connected to a second lead-out wiring.

7. The communication system according to claim 6, to wherein the first lead-out wiring and the second lead-out wiring are provided on the first board.

8. The communication system according to claim 1, wherein the first wiring pattern and the second wiring pattern each include a thin film of metal.

9. The communication system according to claim 1, further comprising a metal pattern and a second board, different than the first board, wherein the metal pattern is deposed on a surface of the second board;

the first board and second board are stacked; and the metal pattern is deposed on the second board opposite the first wiring pattern on the first board.

10. The communication system according to claim 9, wherein inner diameters and widths of the metal pattern and the first wiring pattern are the same.

11. A communication system including an inductive coupling device, the inductive coupling device comprising:

a first inductor which includes a first wiring pattern with a loop shape having a slit and provided on a first board; and a second inductor which includes a second wiring pattern with a loop shape, provided on a second board and inductively coupled to the first inductor, the second wiring pattern being opposite to the first wiring pattern;

wherein an area of a region surrounded by the second wiring pattern is smaller than an area of a region surrounded by the first wiring pattern.

12. The communication system according to claim 11, wherein the first wiring pattern of a transmitting inductor and the second wiring pattern of a receiving inductor are closely facing each other.

13. The communication system according to claim 12, wherein a center of the loop shape of the first wiring pattern and a center of the loop shape of the second wiring pattern are coincident with each other in a plan view.

14. The communication system according to claim 12, wherein the inductive coupling device further has an insulator sandwiched between the first wiring pattern and the second wiring pattern.

15. The communication system according to claim 14, wherein the second wiring pattern comprises a slit, wherein the slit of the first wiring pattern and the slit of the second wiring pattern are, respectively, a circular shape or an oval shape.

16. The communication system according to claim 15, wherein the first wiring pattern and the second wiring pattern each include a thin film of metal.

17. The communication system according to claim 12, further comprising a metal pattern and a second board, different than the first board, wherein the metal pattern is deposed on a surface of the second board;

the first board and second board are stacked; and the metal pattern is deposed on the second board opposite the first wiring pattern on the first board.

18. The communication system according to claim 17, wherein the metal pattern is circular and shaped as a closed loop.

19. The communication system according to claim 18, wherein inner diameters or widths of the metal pattern and the first wiring pattern are the same.

* * * * *